US006971897B1

(12) United States Patent
Beavers et al.

(10) Patent No.: US 6,971,897 B1
(45) Date of Patent: Dec. 6, 2005

(54) GEL-FILLED TELEPHONE JACK

(75) Inventors: Roger L. Beavers, Brown Summit, NC (US); Victor L. Wright, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/696,485

(22) Filed: Oct. 29, 2003

(51) Int. Cl.[7] ..... H01R 13/52
(52) U.S. Cl. ..... 439/276; 439/936; 379/438
(58) Field of Search ..... 439/276, 936, 439/521, 656, 676; 379/438

(56) References Cited

U.S. PATENT DOCUMENTS

| | | | | |
|---|---|---|---|---|
| 2,819,236 | A | 1/1958 | Dickmann | 260/29.1 |
| 3,020,260 | A | 2/1962 | Nelson | 260/46.5 |
| 3,522,576 | A | 8/1970 | Cairns | 339/91 |
| 3,652,475 | A | 3/1972 | Wada et al. | 260/29.1 |
| 4,008,197 | A | 2/1977 | Brauer et al. | 260/31.6 |
| 4,102,716 | A | 7/1978 | Groves et al. | 156/48 |
| 4,186,986 | A | 2/1980 | Shoemaker | 339/114 |
| 4,284,312 | A | 8/1981 | Patchett et al. | 339/60 |
| 4,299,431 | A | 11/1981 | Wilson et al. | 339/60 |
| 4,382,057 | A | 5/1983 | Tolentino | 264/328.2 |
| 4,425,017 | A | 1/1984 | Chan | 339/96 |
| 4,444,940 | A | 4/1984 | Polmanteer | 524/500 |
| 4,488,771 | A | 12/1984 | Koford | 339/278 |
| 4,504,699 | A | 3/1985 | Dones et al. | 174/84 |
| 4,588,238 | A | 5/1986 | Michelson et al. | 339/91 |
| 4,595,635 | A | 6/1986 | Dubrow et al. | 428/447 |
| 4,596,743 | A | 6/1986 | Brauer et al. | 428/380 |
| 4,600,261 | A | 7/1986 | Debbaut | 339/116 |
| 4,634,207 | A | 1/1987 | Debbaut | 339/116 |
| 4,642,924 | A | 2/1987 | Sudderth et al. | 38/102.2 |
| 4,643,924 | A | 2/1987 | Uken et al. | 428/35 |
| 4,662,692 | A | 5/1987 | Uken et al. | 339/96 |
| 4,680,233 | A | 7/1987 | Camin et al. | 428/424.6 |
| 4,716,183 | A | 12/1987 | Gamarra et al. | 522/80 |
| 4,717,355 | A | 1/1988 | Mattis | 439/452 |
| 4,718,678 | A | 1/1988 | Vansant | 277/1 |
| 4,721,832 | A | 1/1988 | Toy | 174/87 |
| 4,734,061 | A | 3/1988 | Randall, Jr. et al. | 439/709 |
| 4,741,709 | A | 5/1988 | Jervis | 439/521 |
| 4,748,651 | A | 5/1988 | Collins et al. | 379/22 |
| 4,777,063 | A | 10/1988 | Dubrow et al. | 427/44 |

(Continued)

FOREIGN PATENT DOCUMENTS

| | | |
|---|---|---|
| EP | 213 874 | 8/1986 |

(Continued)

OTHER PUBLICATIONS

Corrosion and Moisture Inhibitors for Station Apparatus from AT&T Practice Standard; May 1980.

(Continued)

*Primary Examiner*—Tho D. Ta
(74) *Attorney, Agent, or Firm*—Myers Bigel Sibley & Sajovec

(57) ABSTRACT

An improved gel-protected registered telephone jack includes a cavity in a housing, and a rear opening to the cavity that permits positioning an insert that connects permanent telephone wires to spring connectors. A front opening receives a plug to make contact between wires in the plug and the spring connectors, and a gel on the spring connectors prevents corrosion of the connectors. Guides for the insert are mounted lower in the rear opening than is conventional and the housing adjacent the rear opening extends rearwardly more than is conventional, so the positioned insert is lower and more rearward than is conventional. A retainer binds the insert to the housing and thereby limits fore-and-aft translational movement of the insert within the cavity.

9 Claims, 5 Drawing Sheets

U.S. PATENT DOCUMENTS

| | | | | | |
|---|---|---|---|---|---|
| 4,800,588 | A | | 1/1989 | Poster, Jr. | 379/412 |
| 4,824,390 | A | | 4/1989 | Crane et al. | 439/271 |
| 4,846,721 | A | | 7/1989 | Debruycker et al. | 439/411 |
| 4,849,580 | A | | 7/1989 | Reuter | 174/92 |
| 4,864,725 | A | | 9/1989 | Debbaut | 29/871 |
| 4,865,905 | A | | 9/1989 | Uken | 428/220 |
| 4,917,617 | A | | 4/1990 | Smith | 439/135 |
| 4,924,489 | A | | 5/1990 | Lawrence et al. | 379/6 |
| 4,927,386 | A | | 5/1990 | Neuroth | 439/589 |
| 4,942,270 | A | | 7/1990 | Gamarra | 174/93 |
| 4,945,560 | A | | 7/1990 | Collins et al. | 379/399 |
| 4,971,573 | A | | 11/1990 | Pinyan | 439/412 |
| 4,979,209 | A | | 12/1990 | Collins et al. | 379/399 |
| 4,998,894 | A | | 3/1991 | Gronvall | 439/521 |
| 5,044,981 | A | | 9/1991 | Suffi et al. | 439/533 |
| 5,079,300 | A | | 1/1992 | Dubrow et al. | 525/106 |
| 5,085,597 | A | | 2/1992 | Story et al. | 439/521 |
| 5,102,347 | A | | 4/1992 | Cote et al. | 439/412 |
| 5,104,930 | A | | 4/1992 | Rinde et al. | 524/871 |
| 5,111,497 | A | | 5/1992 | Bliven et al. | 379/27 |
| 5,130,818 | A | | 7/1992 | Tadokoro | 358/407 |
| 5,139,440 | A | | 8/1992 | Volk et al. | 439/413 |
| 5,140,746 | A | | 8/1992 | Debbaut | 29/855 |
| 5,153,910 | A | | 10/1992 | Mickelson et al. | 379/399 |
| 5,153,988 | A | | 10/1992 | Mattis et al. | 29/863 |
| 5,195,125 | A | | 3/1993 | Bliven et al. | 379/29 |
| 5,201,672 | A | | 4/1993 | Story et al. | 439/521 |
| 5,202,919 | A | | 4/1993 | Kiko | 379/399 |
| 5,228,018 | A | | 7/1993 | Rokutan | 369/44.29 |
| 5,229,058 | A | | 7/1993 | Uken et al. | 264/261 |
| 5,235,638 | A | | 8/1993 | Dondero | 379/399 |
| 5,246,383 | A | | 9/1993 | Shimirak et al. | 439/521 |
| 5,281,763 | A | | 1/1994 | Hey et al. | 174/84 |
| 5,313,019 | A | | 5/1994 | Brusselmans et al. | 174/93 |
| 5,333,193 | A | | 7/1994 | Cote et al. | 379/399 |
| 5,357,057 | A | | 10/1994 | Debbaut | 174/84 |
| 5,359,654 | A | | 10/1994 | Jensen et al. | 379/397 |
| 5,376,019 | A | * | 12/1994 | Shimirak et al. | 439/521 |
| 5,404,401 | A | | 4/1995 | Bliven et al. | 379/442 |
| 5,406,702 | A | | 4/1995 | Shimirak et al. | 29/883 |
| 5,415,713 | A | | 5/1995 | Vatcher | 156/48 |
| 5,422,438 | A | | 6/1995 | Lamome | 174/84 |
| 5,427,547 | A | | 6/1995 | Shimirak et al. | 439/521 |
| 5,431,758 | A | | 7/1995 | Delalle | 156/49 |
| 5,442,004 | A | | 8/1995 | Sutherland et al. | 524/140 |
| 5,449,299 | A | | 9/1995 | Shimirak et al. | 439/417 |
| 5,518,415 | A | | 5/1996 | Sano | 439/204 |
| 5,541,250 | A | | 7/1996 | Hudson et al. | 524/505 |
| 5,548,641 | A | | 8/1996 | Butler et al. | 397/399 |
| 5,557,250 | A | | 9/1996 | Debbaut et al. | 338/21 |
| 5,562,491 | A | * | 10/1996 | Shimirak et al. | 439/521 |
| 5,588,869 | A | | 12/1996 | Jensen et al. | 439/417 |
| 5,595,504 | A | | 1/1997 | Muller | 439/521 |
| 5,598,455 | A | | 1/1997 | Bliven et al. | 379/27 |
| 5,601,460 | A | | 2/1997 | Shimirak et al. | 439/936 |
| 5,618,882 | A | | 4/1997 | Hammond et al. | 525/92 |
| 5,797,759 | A | | 8/1998 | Mattis et al. | 439/201 |
| 5,800,028 | A | | 9/1998 | Smith et al. | 312/223.1 |
| 5,863,215 | A | | 1/1999 | Debbaut et al. | 439/412 |
| 5,888,085 | A | | 3/1999 | Meyerhoefer et al. | 439/188 |
| 5,901,220 | A | | 5/1999 | Garver et al. | 397/399 |
| 5,934,934 | A | | 8/1999 | Ward | 439/521 |
| 5,957,729 | A | * | 9/1999 | Federowicz | 439/656 |
| 6,074,240 | A | | 6/2000 | Bradshaw et al. | 439/412 |
| 6,093,050 | A | | 7/2000 | Baum et al. | 439/412 |
| 6,093,053 | A | | 7/2000 | Horioka et al. | 439/444 |
| 6,113,419 | A | | 9/2000 | Finley | 439/418 |
| 6,135,811 | A | | 10/2000 | Daoud | 439/519 |
| 6,224,419 | B1 | | 5/2001 | Tucker et al. | 439/521 |

FOREIGN PATENT DOCUMENTS

| | | |
|---|---|---|
| EP | 319 306 | 12/1988 |
| WO | WO 90/10035 | 9/1990 |
| WO | WO 90/15038 | 12/1990 |
| WO | WO 92/08257 | 5/1991 |
| WO | WO 93/07654 | 4/1993 |
| WO | WO 95/12235 | 5/1995 |
| WO | WO 96/02080 | 10/1996 |
| WO | WO 97/05671 | 2/1997 |
| WO | WO 97/19143 | 5/1997 |
| WO | WO 97/35363 | 9/1997 |

OTHER PUBLICATIONS

Silicone Oils, Fluids and Compounds from AT&T Practice Standard; Mar. 1980.

Generic Requirements for Modular connecting Blocks from Bellcore; 1993.

Article entitled PTD Module from Siecor; Jun. 1996.

ADSL POTS Splitter PTD Line Module from Corning Cable Systems; copyright 2000.

AT&T News Release; Raychem and AT&T form joint venture for sealed cable blocks; Mar. 8, 1994.

Customer Premise Systems; RJ-11 Flush Mount Wall Jack; copyright 2000.

GelGuard article from Tyco Electronics, available before 2003.

CSI/Suttle News Flash, Corro Shield "Takes Country by Storm", Jul. 15, 1998.

Improving Voice and Data Network Reliability and Reducing Service Costs, available before 2003.

Surface Mount Jacks and Jack Assemblies from Suttle Apparatus, available before 2003.

Definitions from the American Heritage Dictionary of the English Language, available before 2003.

Making a Good Connection in a Hostile Environment from CSI/Suttle; available before 2003.

Article entitled Corr Shield Products from Suttle apparatus Make Service Calls a thing of the Past. Jan. 23, 1998.

Article entitled The River Ran Through It; 1997.

* cited by examiner

GEL-FILLED TELEPHONE JACK

BACKGROUND OF THE INVENTION

The present invention relates to an improved gel-protected telephone jack.

Telephone jacks have been standard in the telephone industry for some thirty years dating back to the adoption of the registered jack under a Universal Service Order Code system devised by AT&T and adopted by the Federal Communications Commission. The location of these jacks in areas of high humidity and other potentially corrosive environments have caused their premature failure. Attempts have been made over the years to correct this problem by applying a protective coating in the form of gels on the exposed connectors of conventional jacks.

For the most part the gels have been applied to standard jacks without modifications to the jacks. The gel is purported to have properties so that it can be pushed out of the way when a connection is made by the insertion of a plug, so that contact between the plug and connectors in the jack can be made. Upon removal of the plug, a memory in the gel is supposed to cause the gel to flow back into position covering the connectors, so the gel can continue its role of providing environmental protection. However, it has been found that the gel does not survive many such insertions and removals of the plug. Often the gel is physically damaged by the plug insertion, so that upon removal of the plug, the gel does not flow back into its protective covering position.

Various attempts to rectify this problem including the use of the elasteromic walls that are to deflect upon plug insertion and return to an original configuration have not proven to be satisfactory solutions.

Accordingly, there is a need in the art for an improved telephone jack specifically designed to receive such gels and provide improved longevity to the gel.

The assignee of this application is also the assignee of U.S. patent application Ser. No. 10/142,716 filed May 9, 2002, the entire disclosure of which is incorporated herein by reference. That application discloses an improved gel-protected registered telephone jack of the type including a housing, a cavity in the housing, a rear opening in the housing communicating with the cavity to permit positioning of an insert that connects permanent telephone wires to spring connectors, a front opening in the housing communicating with the cavity to receive a plug so as to make contact between wires in the plug and the spring connectors with a gel on the spring connectors to prevent corrosion of the connectors. The improvement may include guides for the insert mounted lower in the rear opening to the housing than in conventional registered jacks and the housing adjacent the rear opening extending rearwardly more than in conventional registered jacks, so that the positioned insert is lower and more rearwardly than in conventional registered jacks. This typically provides more room for gel displacement upon insertion of a plug. The guides may be slanted more downwardly from the rear to the front of the housing than in conventional registered jacks so that the positioned insert slants downwardly more than in conventional registered jacks. The slant typically provides a more gradual impact of a received plug than in conventional registered jacks.

In one embodiment, of our prior application the rear opening is wider in a lower portion thereof than on conventional jacks so that, with the rear facing upward, bubbles in gel applied in a liquid state can escape. It is also desirable to make the rear opening wider in an upper portion thereof than on conventional jacks so that, with the rear facing upward, gel can be applied in a liquid state proximate the spring connectors. The housing has grooves on opposite sides of the front opening extending from a lower front part of the front opening to an upper rear part of the front opening so that a temporary plate may be fitted in the grooves to serve as a dam so that, with the rear facing upward, gel can be applied in a liquid state and not run out of the front opening. Preferably, the insert is a body with a front and a top and the spring connectors extend out of the front and bend rearwardly over at least part of the top, with the intersection of the front and top being a curved edge. The curved edge prevents the gel from being cut, as occurs with conventional gel-protected registered jacks.

The housing disclosed in our prior application typically has a plurality of flanges extending downward into the rear opening to serve as dividers for the spring connectors and the rear opening preferably has spaces outward of the flanges to receive gel displaced when a plug is inserted. The gel has an outer surface and a protective compound on the outer surface to provide a slick surface so the plug can slide over the gel. However, it has been found that further improvements to the housing can be beneficial. In particular it has been found that the possibility of fore-and-aft movement of the insert arising from the previously described structure may prevent the gel from flowing back into its protective covering position.

SUMMARY OF THE INVENTION

This present invention provides a retainer that binds the insert to the housing, thereby limiting fore-and-aft translational movement of the insert within the cavity. A fastening process may permanently secure the retainer to the housing. Examples of the fastening process include: ultrasonic welding, forming, bonding, and gluing. The retainer is typically installed adjacent to the insert's rear end. The retainer preferably limits the insert's linear and rotational movement. The retainer preferably provides access to the rear end of the insert. The invention is useable with the subject matter of application Ser. No. 10/142,716 as a preferred embodiment. However, it may also have utility with conventional jacks.

BRIEF DESCRIPTION OF THE DRAWINGS

The invention will be better understood by a reading of the Detailed Description of the Preferred Embodiments along with a review of the drawings, in which.

DETAILED DESCRIPTION OF THE PREFERRED EMBODIMENT

The invention will best be understood with respect to modifications to conventional jacks and the jack of our prior application Ser. No. 10/142,716. The invention will be described in particular with respect to an RJ11 jack. It will be appreciated that other jacks in accordance with the Universal Service Order Codes can be made with similar modifications and are within the scope of the present invention. USOC, Universal Service Order Codes, were developed in the 1970's by AT&T to identify tariffed services and equipment. These codes were lated adopted in part by the FCC, Part 68, Subpart F, Section 68.502. Each of the basic jack styles can be wired for different RJ configurations. For example, the 6-position jack can be wired as an RJ11C (1-pair), RJ14C (2-pair), or RJ25C (3-pair) configuration. An 8-position jack can be wired for configurations such as RJ61C (4-pair) and RJ48C. The keyed 8-position jack can be wired for RJ45S, RJ46S, and RJ47S. The following categories are suitable for use in connection with the invention: RJ11; RJ11C; RJ11W; RJ14C; RJ14W; RJ25C; RJ31X; RJ38X; RJ45S; RJ48C; RJ48S; RJ48X; and RJ61X.

Figure 1:
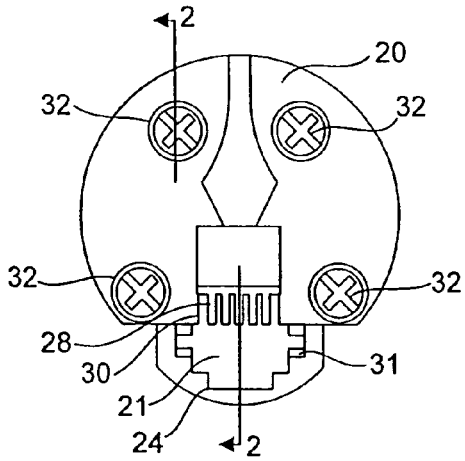
FIG. 1 is a rear view of a conventional registered telephone jack.
Figure 3:
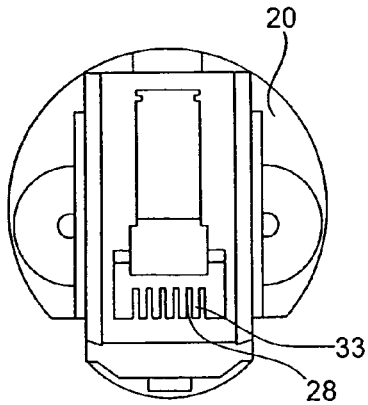
FIG. 3 is a front view of the jack of FIG. 1.
Figure 2:
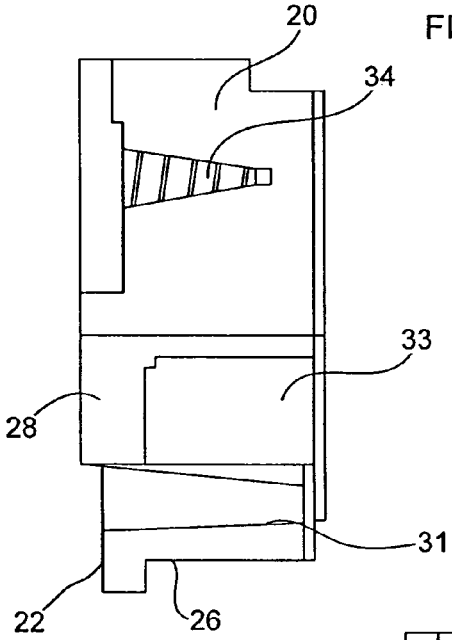
FIG. 2 is a sectional view of the embodiment of FIG. 1 taken along lines 2—2 and looking in the direction of the arrows.
Figure 5:
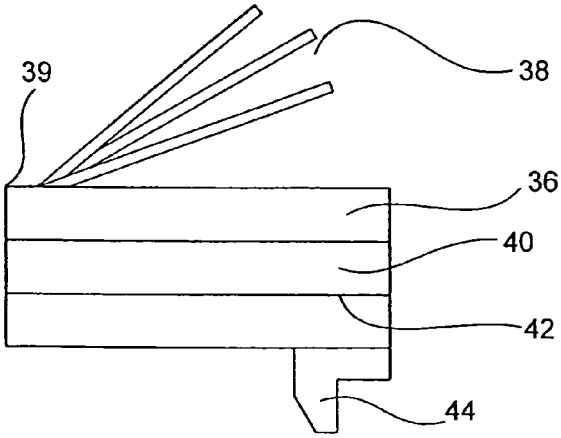
FIG. 5 is a side view of a conventional insert.
Figure 4:
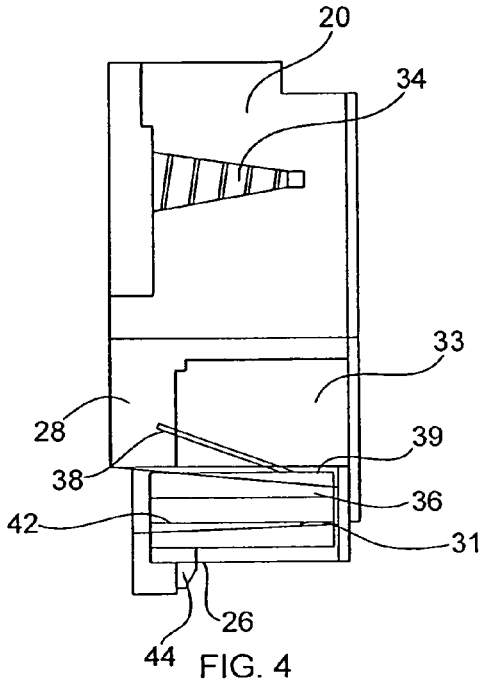
FIG. 4 is a sectional view of a conventional jack with an insert in place.

Referring now to FIG. 1, a rear view of a conventional RJ11 jack 20 is seen. The jack housing 20 has a rear opening 21 in a lower portion of the housing to receive an insert having telephone wire conductors. A plurality of mounting posts 32 in the form of screws which fit into threaded holes 34 (FIG. 2) are provided for wiring connections from the insert to the jack. The opening 21 has a narrowed portion 24 in the lower portion and a guide surface 31 sloping from the rear to the front of the jack 20. The surface 31 provides a guide surface for a shoulder 42 on the insert shown in FIG. 5. The surface 31 is better seen in FIG. 4 in which the insert 36 is shown in place. As seen, the end is tilted rearward in place because of the interaction of the shoulder 42 on the insert with the guiding surface 31 of housing 20. Spring connectors 38 extend through the body of the insert 36 and when, located in the jack 20, are interleaved with dividers 28. Bounding a portion of the opening 21 on either side of the dividers 28 are narrow spaces 30. As seen in FIGS. 2 and 4, a release tab 44 extends below the main body of the insert 36 and protrudes from an opening 26 in the jack 20.

An opening 33 on the front of the jack is sized to securely receive a plug. The plug (not shown) is provided with conductors which contact conductors 38 and has wires leading to equipment to be connected to the jack.

The conventional manufacturing method is to use a jack as described with respect to FIGS. 1–4 and apply get to the connectors 38 to protect them from environmental exposure and possible corrosion. The application of gel to the contacts 38 is conventionally done using a procedure in which the insert 38 is coated with the gel in a separate fixture prior to application into the jack 20. Problems have occurred in connection with conventional designs primarily relating to a lack of reliability of gel to stay in place after numerous insertions of a plug into the hole 33, because the plug tends to push the gel out of the way. In addition, the contact of the gel with a leading edge 39 of the insert causes the gel to be cut and sheared. This problem is exacerbated by the fact that the corner 39 is elevated with respect to the body of the insert 36 by virtue of its position, dictated by the slant on the guide surface 31.

Figure 6:
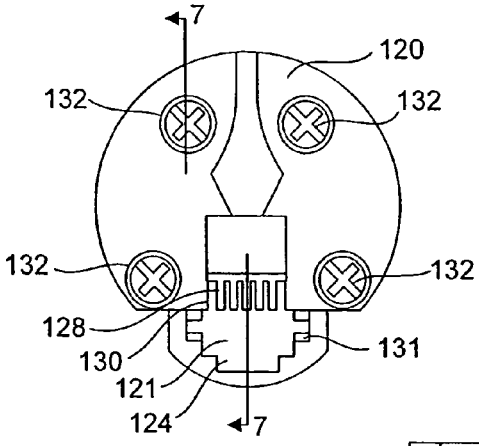
FIG. 6 is a rear view of a registered telephone jack in accordance with a first embodiment of the invention of my prior application Ser. No. 10/142,716.

Referring now to FIG. 6, a first embodiment of an improved jack in accordance with our prior invention can be seen. The jack has been specifically modified to receive the gel, with the gel being applied to the insert once it is located in the housing. The housing 120 is provided with the conventional mounting posts 132 secured in threaded bores 134.

The opening 121 is provided enlarged from the opening 21 of the conventional jack. In particular, the opening is larger at a lower portion 124 to provide additional room for gel insertion. Furthermore, the guide surface 131 is provided with substantially less of a slant, so that the corresponding shoulder 142 on an improved insert 136 (FIG. 10) causes the insert to have a closer to horizontal orientation in the jack. In the preferred embodiment, the change in this angle is about 3 degrees.

Figure 8:
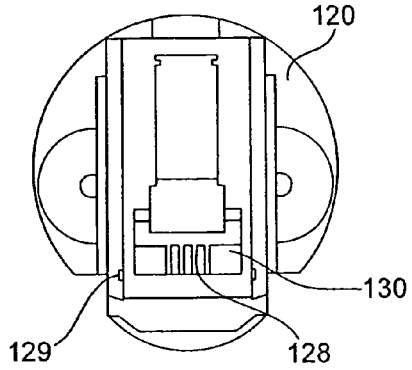
FIG. 8 is a front view of the jack of FIG. 6.
Figure 7:
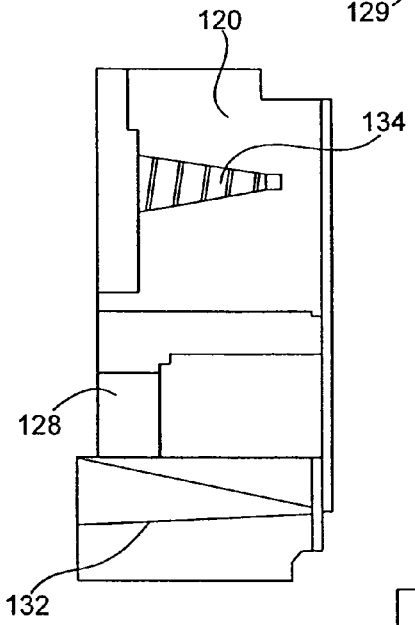
FIG. 7 is a sectional view of the embodiment of FIG. 6 taken along lines 7—7.
Figure 9:
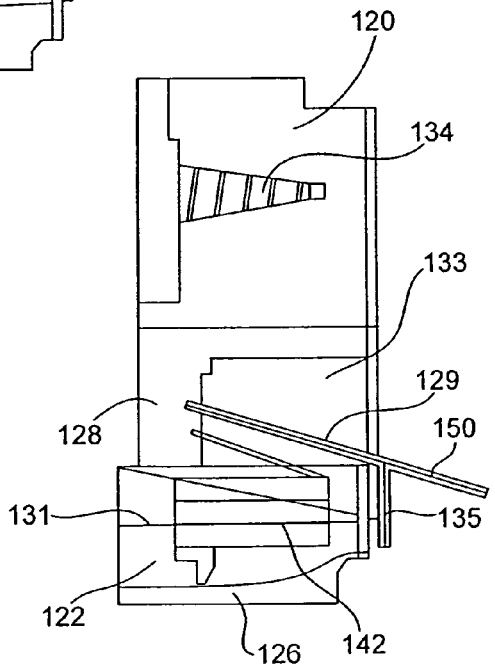
FIG. 9 is a sectional view like FIG. 7, with a modified insert in place.

The jack has the conventional dividers 128, but on either side, an opened space 130 is provided to provide additional room for gel insertion. Finally, as best seen in connection with FIG. 8, the front opening 130 is provided with a groove 129 on its right and left side which extends rearwardly, slanting upward, as seen in FIG. 9. FIG. 9 shows the groove filled with a temporary dam 150 having a downward face 135 so the dam substantially covers the front opening 130. The dam 150 is in place temporarily to close off the front opening of the jack housing 120 for gel insertion. As seen also in FIG. 9, a lower wall 126 is provided substantially closed to prevent gel from running out during insertion. Finally, as seen in FIGS. 7 and 9, the rear face 122 of the lower portion of the housing is extended rearwardly in comparison with the rear face 22 of the conventional jack, so as to provide additional room in the housing for the position of the insert 136. Thus, the forward face of the insert is not as far forward in the jack 122 as the comparable forward face of the insert in a conventional jack.

The jack can be filled with gel by the placement of the temporary dam 150 after placement of the insert 136. The rear of the jack can then be faced upwardly and the liquid gel compound can be inserted and allowed to cure to form a gel that stays in place. Preferably, the dam 150 is coated with a release compound so that it can be removed once the gel has set. Subsequently, the gel can be provided with a mold release coating that acts as a protective compound to give the gel a slick surface. When the plug is inserted, the coating causes it to slide over the top of the gel, rather than cutting it. As it slides, spring conductors 138 are exposed to make contact with the contacts on the plug.

Figure 10:
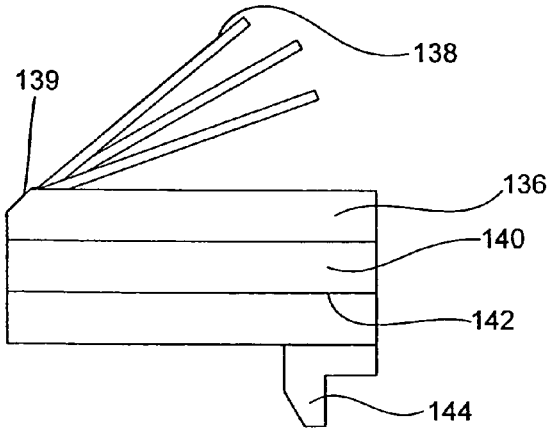
FIG. 10 is a side view of an insert in accordance with the preferred embodiment of the invention of my prior application Ser. No. 10/142,716.

Referring to FIG. 10, a modification of the insert can be seen. The leading edge 139 of the insert between the top and front of the insert is provided with a curved top around which the spring conductors 138 extend. This curved surface has a reduced tendency to cut the gel so that the gel remains serviceable for a longer period. This feature, combined with the less slanted presentation of the insert and the more rearward positioning of the insert in the housing all combine to help preserve the longevity of the gel. Tests have shown that even after 500 insertions and withdrawals of a plug, the gel stays serviceable.

Figure 11:
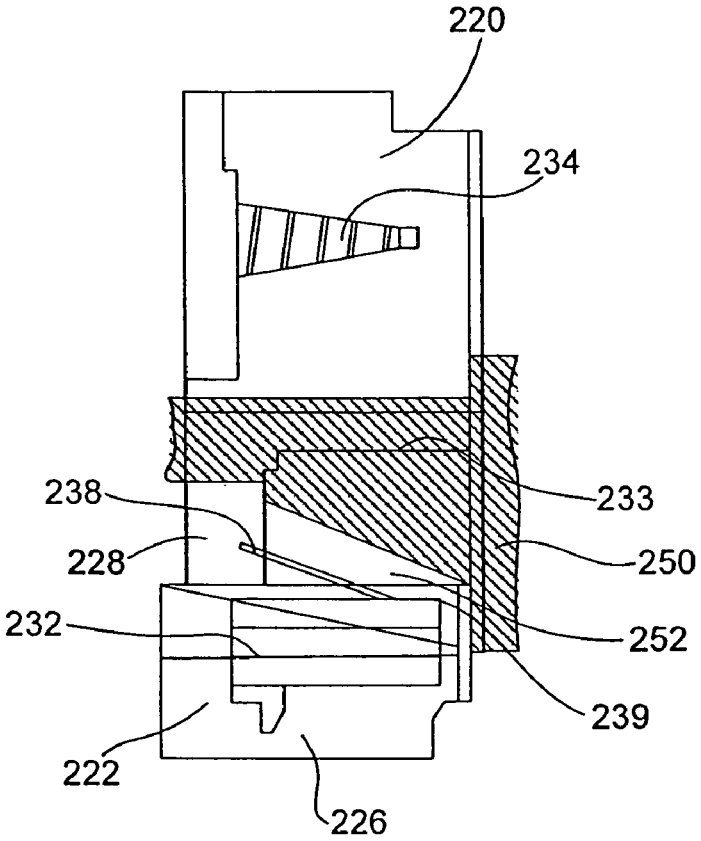
FIG. 11 is a sectional view of a modified form of the invention of my prior application Ser. No. 10/142,716.
Figure 12:
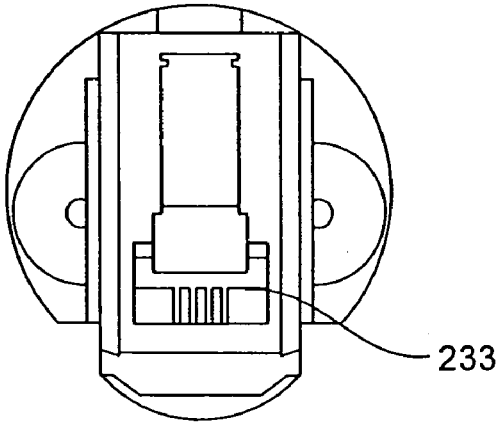
FIG. 12 is a front view of the embodiment of FIG. 11.

An alternate embodiment of our prior invention is seen in FIGS. 11 and 12. FIG. 11 is a sectional view of a modified jack 220 having the conventional threaded bores 234. As with the prior embodiment, the bottom 226 is closed and the rearward portion of the housing 222 extends rearwardly more than in a conventional design. Similarly, the guide surface 232 is less sloped than is conventional. The grooves 129 of the first embodiment are omitted in this embodiment. A different damming method is used in connection with this embodiment. A plug 250 is provided which substantially fills the upper portion of the opening 233, leaving a channel 252 above the spring contacts 238 which, as before, are separated by dividers 228. The plug 250 is coated with a release coating to prevent gel from sticking to it. In the embodiment of FIG. 11, the plug 250 is inserted, the gel is placed rearwardly upward and the liquid gel can be applied, be allowed to set, and then the plug 250 is removed, leaving the gel in place. As before, a protective mold release compound or coating can be applied to the gel to provide a slick surface.

Figure 13:
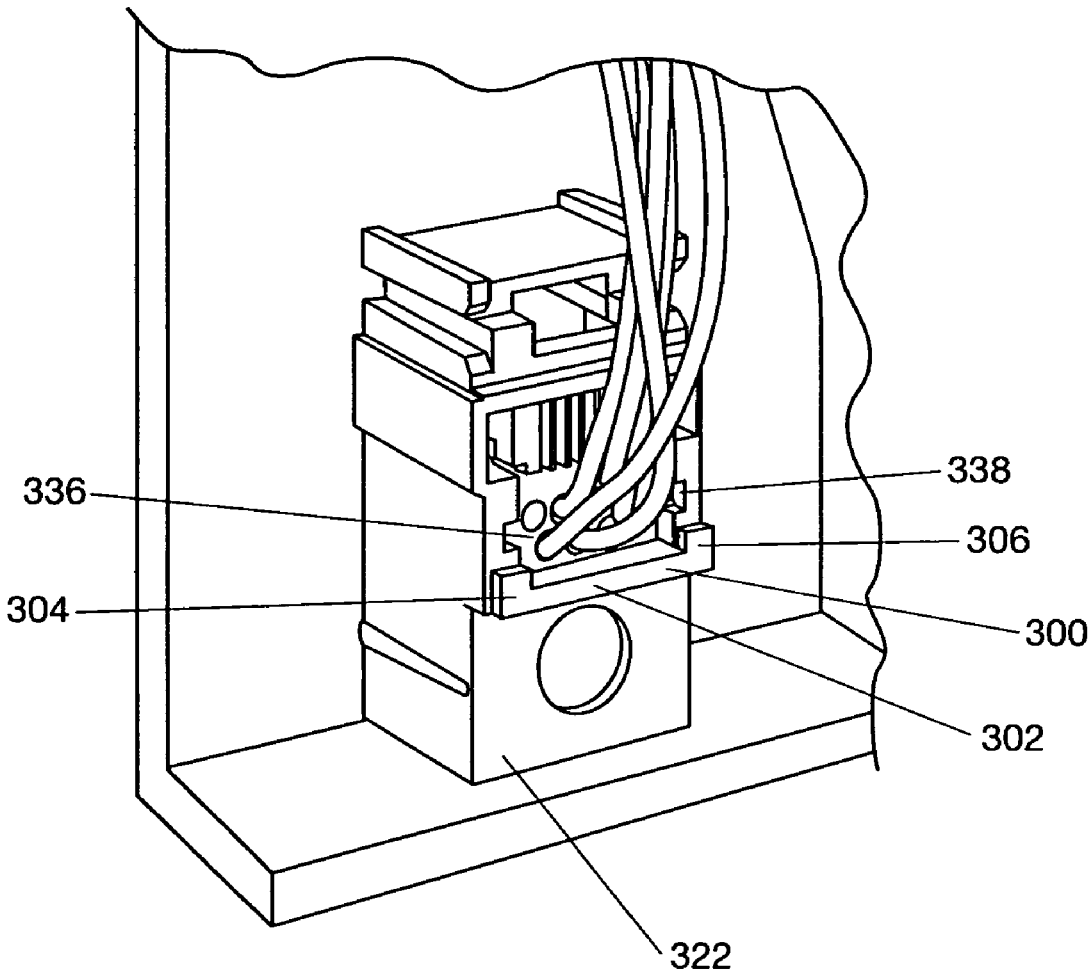
FIG. 13 is a lower rear perspective view of the preferred embodiment of this invention.

FIG. 13 depicts an embodiment of the present invention. The improvement of this invention may be used with one or more of the improved features described above as originally disclosed in our application Ser. No. 10/142,716. A retainer 300 binds the insert to the housing 322 and thereby limits fore-and-aft translational movement of the insert 336 within the cavity 338. Retainer 300 is permanently installed to the rear of the insert 336, but after installation, retainer 300 provides access to the rear end of the insert 336. In the embodiment of FIG. 13, retainer 300 includes a bar 302 having two ends 304, 306 extending across the rear of the housing 322. The bar's two ends are rigidly joined to the housing 322 and a mid portion of bar 302 is fastened to the insert 336. Retainer 300 is installed to the housing via a permanent fastening means. A few examples of the permanent fastening means consist of ultrasonic welding, forming, bonding, and gluing with ultrasonic welding the presently preferred method. Fastening to the insert 336 may not be necessary if the bar 302 is configured to bear against the insert 336 and thereby position the insert 336 forwardly against the front wall of the housing 322.

A benefit of this invention is that retainer 300 omits the need for the conventional release tab 44 that extends below the main body of the insert 336 and the opening 26 in housing 322, saving manufacturing costs. The permanent fastening means used to install retainer 300 provides accurate front-to-rear positioning of the insert 336. Retainer 300 avoids users' and installers' tampering with the insert 336 inside housing 322 or jack 320 and disturbing the gel placement.

Figure 14:
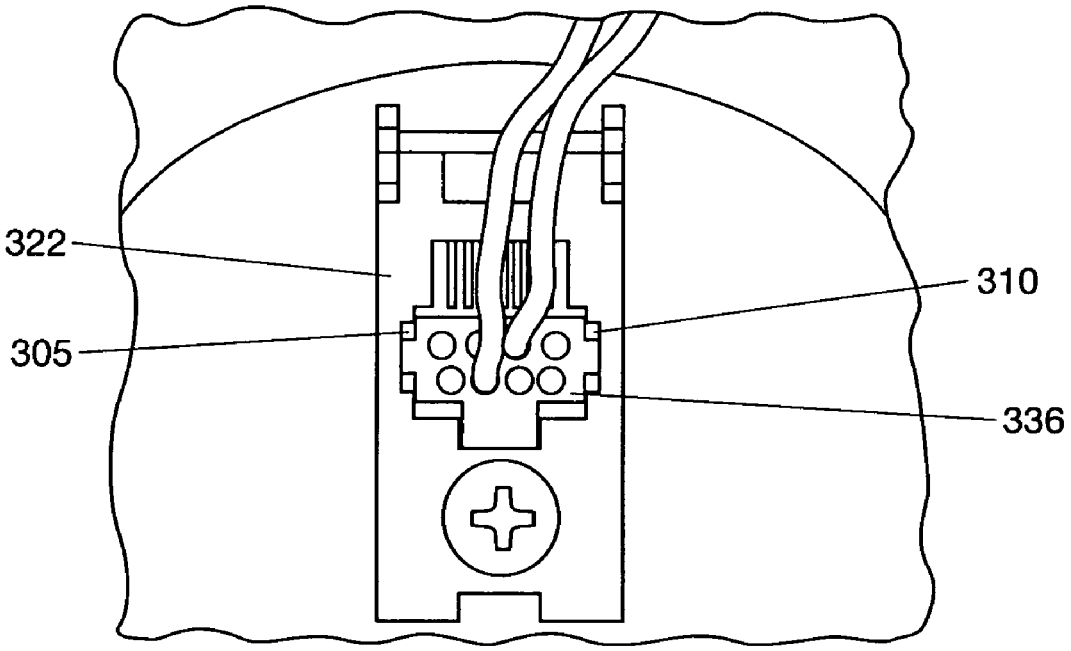
FIG. 14 is a lower rear perspective view of an alternate embodiment of this invention.

FIG. 14 shows an alternate embodiment of the invention. Lug 305 and lug 310 may share identical physical characteristics. Lugs 305 and 310 bind the insert 336 to the housing 322 and thereby limit fore-and-aft translational movement of the insert within the cavity, while they provide access to the rear end of the insert. Lug 305 and lug 310 are installed opposing each other on the housing 322 surface including guide surface 331.

As mentioned, the modifications described above can be applied to various types of registered jacks, in addition to RJ11 jacks.

In the USOC Number Suffixes, the following nomenclature is conventional:

RJ (Registered Jack) numbers end with a letter that indicates the wiring or mounting method:

"C" identifies a surface or flush-mounted jack.

"W" identifies a wall-mounted jack.

"X" identifies a complex multi-line or series type jack.

Single line phones, accessories, answering machines, and modems use the RJ11C or RJ11W jack.

Two line phones, accessories and answering machines use the RJ14C or RJ14W jack.

Three line phones and accessories use the RJ25C jack.

Four line phones and accessories use the RJ61X jack.

Burglar and fire alarms circuits use the RJ31X or RJ38X jack.

Single line fixed loss loop data installations use the RJ45S jack.

Four wire data circuits use the RJ48C/RJ48X or RJ48S jack.

Preferably, the gel is a silicone gel and has a Cone penetration from about 18.5 mm to about 23.5 mm. The elongation of the gel is from about 2200% to about 2800%. The Voland hardness of the gel is from about 30 to about 46 Gms. The stress relaxation of the gel is from about 69% to about 77%. A preferred gel is Polydimethylsiloxane.

As can be appreciated, each of the various modifications described above, namely closing the bottom of the housing, extending the rear of the housing, changing the guide surface angle for the insert, opening the space right and left of the dividers, and providing a curved front to the insert are advantageously used in a single embodiment. However, it will be appreciated that various ones of these improvements may be used singly or in combination and yet fall within the scope of the invention.

What is claimed is:

1. An improved gel-protected registered telephone jack of the type including a housing, a cavity in the housing, a rear opening in the housing communicating with the cavity to permit positioning of an insert that connects permanent telephone wires to spring connectors, a front opening in the housing communicating with the cavity to receive a plug so as to make contact between wires in the plug and the spring connectors with a gel on the spring connectors to prevent corrosion of the connectors, the improvement comprising: a retainer to bind the insert to the housing and thereby limit fore-and-aft translational movement of the insert within the cavity, wherein the retainer includes a bar having two ends extending across the rear opening and having two ends rigidly joined to the housing and a portion of the bar between the two ends rigidly joined to the insert.

2. A registered jack as claimed in claim 1 wherein the retainer is installed by a permanent fastening process.

3. A registered jack as claimed in claim 1 wherein the retainer provides access to the rear end of the insert.

4. A registered jack as claimed in claim 1 wherein the registered jack is selected from the group consisting of RJ11; RJ11C; RJ11W; RJ14C; RJ14W; RJ25C; RJ31X; RJ38X; RJ45S; RJ48C; RJ48S; RJ48X; and RJ61X.

5. A registered jack as claimed in claim 1 wherein the bar is surface mounted on the housing.

6. A registered jack as claimed in claim 1 wherein the bar is ultrasonically welded to the insert.

7. A registered jack as claimed in claim 1 wherein the retainer is ultrasonically welded to the insert and the housing.

8. A registered jack as claimed in claim 1 wherein the retainer includes two lugs, installed opposing each other.

9. A registered jack as claimed in claim 8 wherein the lugs are ultrasonically welded to the housing.

* * * * *